US006016569A

United States Patent [19]

Everett et al.

[11] Patent Number: 6,016,569

[45] Date of Patent: Jan. 25, 2000

[54] SWIMSUIT WITH DISPLACEABLE CROTCH

[76] Inventors: Betty L. Everett, 99 Gentry Rd., Kingston, Ga. 30145; Jane K. Williams, 1484 Morrison Campground Rd., NE., Rome, Ga. 30161

[21] Appl. No.: 09/025,013

[22] Filed: Feb. 17, 1998

Related U.S. Application Data

[63] Continuation-in-part of application No. 08/612,126, Mar. 7, 1996, Pat. No. 5,717,998.

[51] Int. Cl.[7] ..... A41D 7/00; A41B 9/00

[52] U.S. Cl. ..... 2/67; 2/78.2; 2/408; 450/102

[58] Field of Search ..... 2/67, 78.2, 408, 2/73, 78.3, 213; 450/102, 103, 104

[56] References Cited

U.S. PATENT DOCUMENTS

| | | | |
|---|---|---|---|
| D. 138,422 | 8/1944 | Mitchell | D3/17 |
| D. 239,667 | 4/1976 | Bouchard . | |
| 436,607 | 9/1890 | Litle . | |
| 599,408 | 2/1898 | Uppercu . | |
| 959,441 | 5/1910 | Anderson . | |
| 1,954,526 | 4/1934 | Holahan | 2/67 |
| 2,060,689 | 11/1936 | Read | 2/67 |
| 2,258,502 | 10/1941 | Perez | 2/67 |
| 2,412,502 | 12/1946 | Garrison | 2/67 |
| 2,463,309 | 3/1949 | Prince | 2/67 |
| 2,567,442 | 9/1951 | Mitchell | 2/67 |
| 2,857,600 | 10/1958 | Finn | 2/67 |
| 3,036,574 | 5/1962 | Jeffrey | 128/454 |
| 3,068,488 | 12/1962 | Rodriguez | 2/212 |
| 3,279,469 | 10/1966 | Schustack | 128/526 |
| 3,712,308 | 1/1973 | Herbener | 128/519 |
| 3,974,836 | 8/1976 | Carlson | 128/526 |
| 4,494,546 | 1/1985 | Steiman | 450/8 |
| 4,597,110 | 7/1986 | Smith, Sr. et al. | 2/408 |
| 4,694,511 | 9/1987 | Estes et al. | 2/69 |
| 4,835,795 | 6/1989 | Lonon | 2/408 |
| 4,916,755 | 4/1990 | Feigenbaum et al. | 2/67 |
| 5,561,858 | 10/1996 | Poirier | 2/67 |
| 5,717,998 | 2/1998 | Everett et al. | 2/67 |
| 5,915,531 | 6/1999 | Hilpert et al. . | |
| 5,928,059 | 7/1999 | Wicks | 450/155 |

*Primary Examiner*—John J. Calvert
*Assistant Examiner*—Shirra L. Jenkins
*Attorney, Agent, or Firm*—Womble Carlyle Sandridge & Rice

[57] ABSTRACT

A one-piece lady's swimsuit has an upper portion that covers the upper body and a displaceable lower portion that includes a crotch section for covering a wearer's crotch. The displaceable lower portion can be detached and swung down and out of the way for using the restroom and swung back and up where it is secured in place to present a fashionable stylish swimsuit design.

3 Claims, 5 Drawing Sheets

SWIMSUIT WITH DISPLACEABLE CROTCH

REFERENCE TO RELATED APPLICATION

This application is a continuation-in-part of pending U.S. patent application Ser. No. 08/612,126 filed Mar. 7, 1996, now U.S. Pat. No. 5,717,998 issued Feb. 17, 1998.

TECHNICAL FIELD

The present invention relates to clothing and more particularly to women's swimsuits.

BACKGROUND OF THE INVENTION

For many years, women have worn one and two-piece bathing suits and swimsuits for purposes of sun bathing and swimming. Typically, women's bathing suits are made of expandable elastic material so that they fit tightly about the body when worn. While tight fitting suits are popular because they accent body contours and provide minimum interference for swimmers, they nevertheless embody certain inherent problems and shortcomings. For example, putting on and taking off a tight fitting once-piece swimsuit can be quite a chore, particularly when the swimsuit is wet. Even more troublesome to many women who wear single-piece bathing suits is the requirement that the entire suit be removed when it is necessary to use the restroom. Not only can this be embarrassing at public beaches, swimming pools, and the like, the inherent difficulty in taking a wet suit off and putting it back on in a crowded restroom can be time consuming and frustrating. A swimsuit designed to allow its wearer to use the restroom without removing the suit completely would thus be highly desirable.

Attempts to provide one-piece women's bathing suits with removable or displaceable crotch portions have been made. U.S. Pat. No. 2,857,600 of G. C. Finn, for example, discloses a women's bathing suit having a tubular body that extends below the crotch area to form a partial skirt. Beneath the skirt portion of the tubular body is a crotch piece that can be unzipped from beneath the skirt in the front of the bathing suit and swung back between the legs when it is necessary to use the restroom.

While the configuration of the Finn suit appears to be a step in the right direction, it is nevertheless plagued with its own problems and shortcomings. In particular, the crotch piece, itself, in Finn, along with its zipper and related buttons and snaps are unsightly and unfashionable, and thus must be covered with the skirt portion of the suit. This configuration does not lend itself to modern, more revealing swimsuit fashions wherein the suit rides high on the hips. In addition, the zipper and buttons associated with the crotch piece of Finn can be uncomfortable, particularly when the suit is wet. Further, detaching and displacing the crotch piece in Finn can itself be quite a chore since a zipper and a set of snaps must all be manipulated to remove and replace the piece.

U.S. Pat. No. 3,712,308 of Herbener discloses an alternate solution. In Herbener, a seemingly one piece swimsuit actually comprises two pieces, a top piece and a bottom piece. The top piece is itself a complete one piece suit that extends through the crotch area but that is split in this area to allow access to the toilet. The bottom piece of the Herbener suit is a panty-like garment that fits over the bottom portion of the top piece and covers the split crotch area in normal use. Obviously, the suit disclosed in Herbener also has numerous problems. For example, even though the crotch portion of the upper part of the suit is split, it nevertheless can become soiled when its wearer uses the restroom. Furthermore, the design of the Herbener suit, like the Finn suit, does not lend itself to modern swimsuit fashion, which tends to be slighter and more revealing than the suit shown in Herbener.

Many U.S. patents, such as U.S. Pat. No. 3,974,836 of Carlson, 4,957,110 of Smith, Sr., et al., and U.S. Pat. No. 4,835,795 of Lonon, disclose undergarments with displaceable crotch portions. Clearly, such undergarments are unsuitable for use as swimsuits. Even if they were usable as swimsuits, they nevertheless require fastening means, such as Velcro® strips, for attaching the crotch portion. These are unsightly, unfashionable, and unsuitable for swimsuits and can also be uncomfortable for the wearer.

Accordingly, a continuing and heretofore unaddressed need persists for a one-piece women's swimsuit that allows its wearer to use the restroom without having to remove the suit completely. At the same time, the configuration of the suit should be adaptable to modern, more revealing swimsuit fashion design. Such a swimsuit should also be equally as comfortable as a traditional one-piece swimsuit and should not require zippers, Velcro®, or other fasteners that are unsightly and uncomfortable for the wearer of the suit. A maternity configuration should be available for use by pregnant women. It is to the provision of such a swimsuit that the present invention is primarily directed.

SUMMARY OF THE INVENTION

The present invention, in one preferred embodiment thereof, comprises a onepiece women's swimsuit having an upper portion that covers the torso and a displaceable portion that covers the tummy and extends between the wearer's legs to cover the crotch. The upper portion has a front section that covers the front of the wearer's torso and a back section that covers her back. If desired, a Spandex® panel can be incorporated into the front section covering the tummy to pull the tummy in and provide a more shapely appearance.

The displaceable portion of the suit is integral with and depends from the back section thereof. This displaceable portion includes a relatively narrow crotch section that extends from the bottom of the back section. The crotch section gradually widens to define a front panel having long belt straps that project laterally from the front panel in opposite directions. In one embodiment, the straps are long enough to circle a wearer's torso twice to be tied in the front of the suit. In another, the straps are shorter and are provided with hooks that are fastened together in the back of the suit.

In normal use, the displaceable portion is swung forwardly between the legs and thence upwardly so that the crotch section covers the crotch and the front panel covers the tummy and the Spandex® panel incorporated into the upper portion of the suit. The belt straps in one embodiment are then wrapped from the front of the wearer completely around her back and back to the front where they are tied in a bow. Not only does this hold the displaceable portion in place, it forms a belt and bow design that covers the top edge of the front panel to provide a completely normal appearance. In another embodiment, the straps are wrapped around the wearer's waist and to here back, where they are fastened to each other with hooks. In this embodiment, a flap of material covers the belt straps and the top edge of the front panel. Since there are no zippers, snaps or other fasteners in the front of the suit, there is no need to provide an unfashionable skirt to cover these elements, although a skirt can be provided if desired. In addition, the suit is completely comfortable and, when worn, there appears to be no difference between the suit of the present invention and any other modern, stylish swimsuit.

When the wearer of a swimsuit incorporating the principles of this invention desires to use the restroom, she need only untie the bow in the front of the suit or unsnap the hooks in the back, unwrap the belt straps from around her torso, and swing the displaceable portion of the suit rearwardly back between her legs. Thus, the displaceable portion and crotch section can be removed easily, even when the suit is wet. For replacing the displaceable portion, the wearer simply swings it back forwardly between her legs, pulls the front panel up, rewraps the belt straps, and reties the bow. Thus, the present invention is simple and easy to use and provides a freedom heretofore unheard of among women who wear one piece swimsuits. Finally, the design of the present invention allows for a swimsuit that can ride high on the hips and thus present an appearance that is up-to-date and completely in accord with modem fashion design standards.

In an alternate embodiment of the present invention, a women's swimsuit is provided with an open back and a displaceable portion that is integral with the suits front section. In this embodiment, the displaceable portion swings rearwardly between the legs includes a back panel that covers the lady's fanny in use. Snaps are provided that attach the back panel to the front section of the suit to provide a natural, yet more revealing fashion design. Further embodiments include a child's suit that has snaps and hooks for attaching a displaceable portion to the upper portion of the suit, a maternity version of the suit, and an embodiment that includes separate upper and lower portions wherein the lower portion can be removed completely when necessary for using the restroom.

Thus, a one-piece women's swimsuit is now provided that resolves the problems and shortcomings of the prior art by providing an easily displaceable crotch section that can be displaced and replaced with ease. In addition, applicant's swimsuit is free of unsightly zippers and snaps or, alternatively makes use of their design in the fashion design of the suit to allow for an up-to-date, modern, more revealing, swimsuit that is currently popular, particularly among younger women. The suit of the present invention is also particularly suited for use by pregnant women, who often need to have a suit that is easily put on and taken off while at the pool or the beach. Finally, the suit of the present invention preferably is formed primarily of a single piece of fabric appropriately patterned and sewn. Accordingly, the suit is relatively simple and economical to produce and can be designed in a wide variety of styles and fashions to suit varying tastes. These and other objects, features and advantages of the invention will become more apparent upon review of the detailed description set forth below, when taken in conjunction with the accompanying drawings, which are briefly described as follows.

DETAILED DESCRIPTION OF THE PREFERRED EMBODIMENTS

Figure 1:
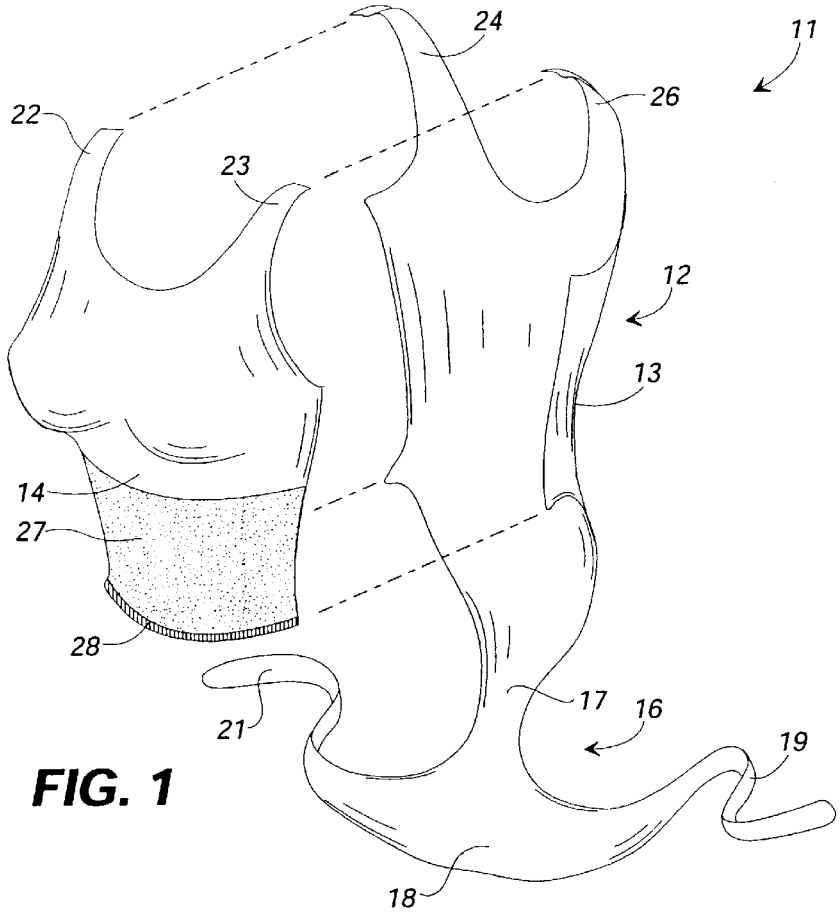
FIG. 1 is a perspective partially exploded view of a one-piece women's swimsuit that embodies principles of the present invention in preferred form.

Referring now in more detail to the drawings, in which like numerals refer to like parts throughout the several views, FIG. 1 illustrates a one-piece women's swimsuit that embodies principles of this invention in a preferred form. While the swimsuit in this figure is shown as an exploded perspective, it will be understood that the suit is actually made as a single piece with the sides and shoulder straps connected and contiguous as illustrated by the dashed explosion line. The suit 11 has an upper portion 12 that comprises a back section 13 and a front section 14. Depending from the back section 13 of the upper portion 12 is a displaceable portion 16 that includes a crotch section 17 and a front panel 18. The displaceable portion 16 narrows at the crotch section 17 and widens gradually to form the front panel 18, which has an upper edge. A first belt section 19 projects laterally from one side of the front panel 18 and a second belt section 21 projects laterally from the other side of the front panel 18 in opposed relationship relative to the first belt section 19. As described more fully below, the length of the belt sections 19 and 21 in this embodiment are selected such that, in use, the belt sections are sufficiently long to wrap around the back of the wearer and back around to the front where they can be tied in a bow.

The front section 14 of the swimsuit has an upper portion that includes shoulder straps 22 and 23. As indicated by the dashed lines in FIG. 1, the shoulder straps 22 and 23 on the front section 14 are continuations of shoulder straps 24 and 26 respectively on the back section 13 of the swimsuit. Preferably, the lower part of the front section 14 is provided with a tummy panel 27 that is formed of spandex or other suitably firm elastic material. As detailed below, the tummy panel 27 acts as a girdle that pulls firmly against the torso of the wearer to provide a more shapely appearance. An elastic strap 28 can be provided if desired to help maintain the swimsuit and particularly the tummy portion in place as the suit is worn by a wearer.

In use, the swimsuit of FIG. 1 is donned by a wearer by pulling the suit over her head until the shoulder straps extend appropriately across her shoulders. When this is done, the displaceable portion 16 hangs freely from the back section 13 of the suit. The user then simply swings the displaceable portion 16 forwardly between her legs and pulls the front panel 18 up across her lower torso until it covers the tummy panel 27 of the suit. At this point, the first and second belt sections 19 and 21 are wrapped around the wearer's back and then back around to her front where the ends of the belt sections are tied together to form a bow. With this configuration, the bow in the front of the suit provides a decorative appearance while, at the same time, the bow and belt straps cover the top edge of the front panel 18 and hold the displaceable portion firmly in place. As an alternative to the bow, a clasp, buckle, or other fastening means could be provided on the ends of the belt straps. Accordingly, the suit appears perfectly normal and does not include any unsightly flaps or other items provided in the prior art to cover up or hide fasteners or unsightly crotch sections.

With the suit appropriately applied as discussed above, the wearer can sunbathe, swim, or engage in any activities for which swimsuits are used. When it is necessary for the wearer to use the restroom, she does not have to take off the entire suit, which can be troublesome when the suit is wet and, in any event, can be embarrassing in public restrooms and other locations. Instead, the wearer need only untie the bow in the front of the suit, unwrap the belt sections 19 and 21 from around her torso, and swing the displaceable portion 16 down and back between her legs so that it is completely out of the way. When she is finished, she need only swing the displaceable portion 16 forward and up, rewrap the belt sections 19 and 21, and retie the bow in the front of the suit. Thus, the swimsuit of this invention provides unprecedented freedom and ease for the user while avoiding the trouble, discomfort, and embarrassment inherent in traditional and prior art bathing suits.

Figure 2A:
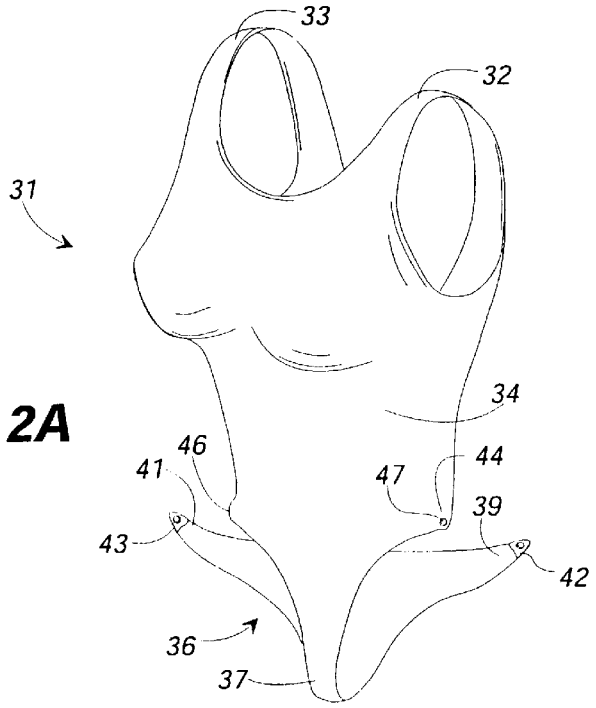
FIGS. 2A and 2B illustrate the present invention in an alternate embodiment having an open back and a more revealing cut.
Figure 2B:
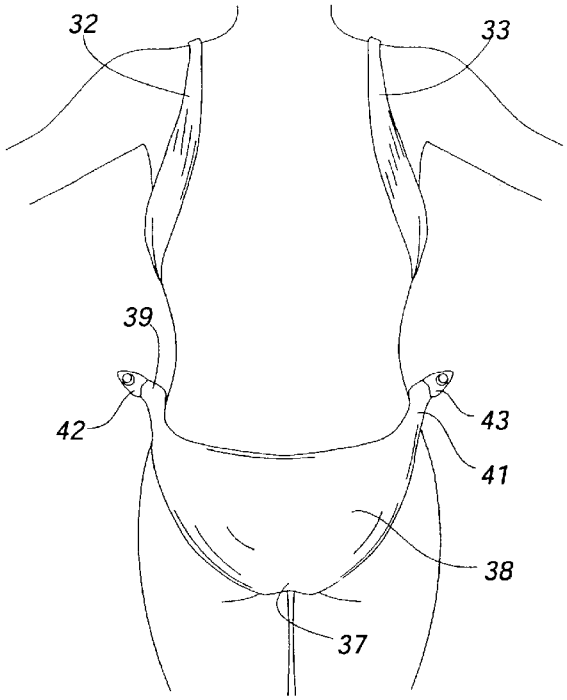

FIGS. 2A and 2B illustrate an alternate embodiment of the present invention that, in use, presents an open back configuration popular among teenage girls and young women. In this embodiment, the suit 31 has an upper portion which includes shoulder straps 32 and 33 and front section 34. The lower portion of the bathing suit is formed to define a displaceable portion 36 that includes a crotch section 37 and a back panel 38. The back panel 38 tapers outwardly from the crotch section 37 to respective ends or corners 39 and 41. Corner 39 is provided with a clasp 42 and corner 41 is provided with a clasp 43. The tummy panel 34 of the upper portion of the suit terminates in tabs 44 and 46 at its lower corners. Each of the tabs 44 and 46 is provided with a clasp hook 47. The clasp hooks 47 are adapted to couple with the clasps 42 and 43 so that the corners 39 and 41 of the back panel 38 can be attached to the tabs 44 and 46 at the lower corners of the tummy panel 34. In this way, the displaceable portion 36 can be releasably fastened to the lower portion of the tummy panel 34 as illustrated in FIG. 2A.

FIG. 2B illustrates the suit 31 of FIG. 2A as worn a by a user and as seen from the back. The shoulder straps 32 and 33 are seen to extend over the wearer's shoulders and wrap back around toward the front of the wearer to present an open back configuration of the suit. The displaceable portion 36 is then swung back between a wearer's legs and then up so that the back panel 38 covers the wearer's fanny. The corners 39 and 41 of the back panel 38 are then wrapped around the wearer's hips and fastened to the tabs 44 and 46 on the bottom of the tummy panel 34. In this way, a highly fashionable swimsuit for teenage girls and younger women is formed.

When the wearer of the suit of FIGS. 2A and 2B desires to use the restroom, she need only unfasten the clasps 42 and 43 and swing the displaceable portion 36 down and forward until it is completely out of the way. When she is finished, the process is reversed and the suit is quickly and easily refastened without having to take off the entire suit.

While decorative clasps 42 and 43 have been illustrated with this embodiment, it will be understood that a variety of different fastening means may be used and that any such fastening means is contemplated to be with in the scope of the present invention.

Figure 3A:
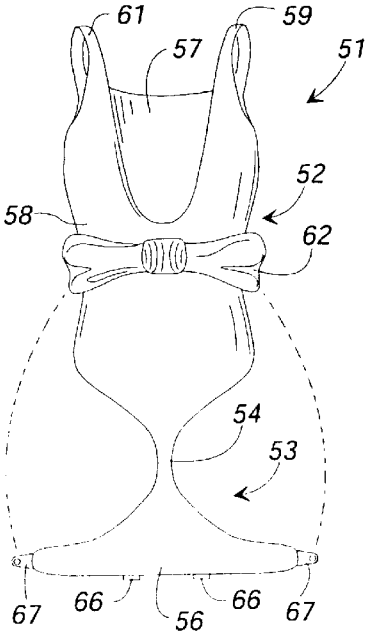
FIGS. 3A through 3C illustrate the present invention in an alternate embodiment designed for use by small girls and children.
Figure 3B:
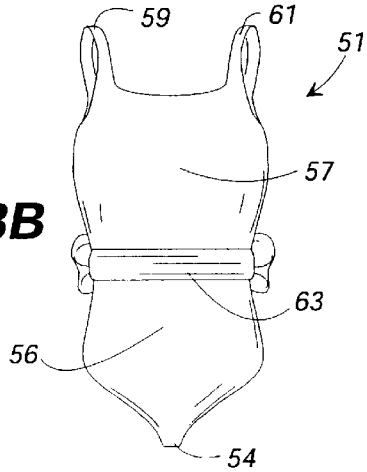
Figure 3C:
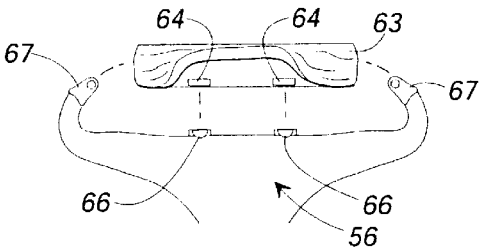
Figure 4A:
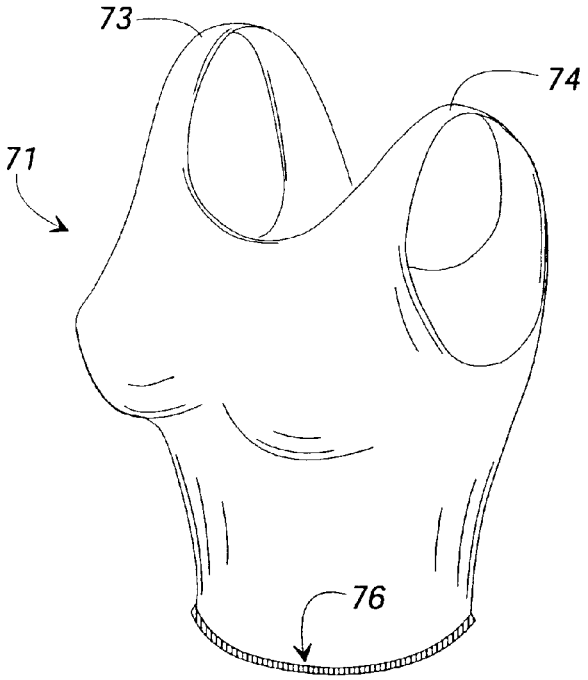
FIGS. 4A through 4D illustrate an embodiment that incorporates separate swimsuit pieces for accomplishing the objects of the invention.
Figure 4C:
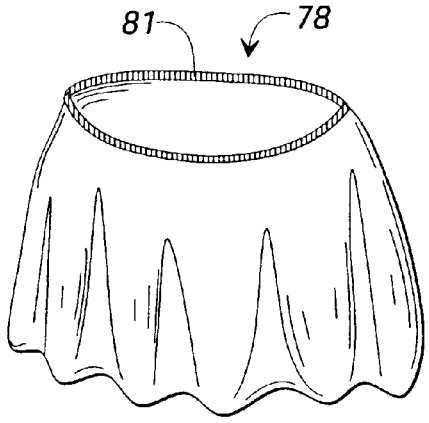
Figure 4B:
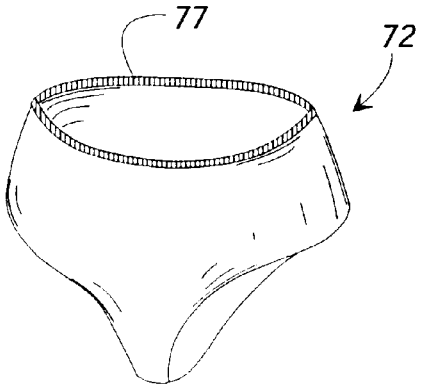
Figure 4D:
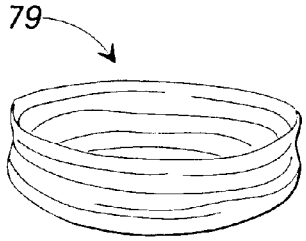

FIGS. 3A through 3C illustrate yet another embodiment of the present invention primarily intended for use by small girls. FIG. 3A is a back view of the suit of this embodiment, FIG. 3B is a front view showing the suit as it appears when worn, and FIG. 3C illustrates the snap system used to connect the sections of the suit. The suit 51 comprises an upper portion 52 and a displaceable portion 53 that comprises a crotch section 54 and a front panel 56. The upper portion 52 comprises a front section 57 that covers the front of the wearer and a back section 58 that covers the back of the wearer. Straps 59 and 61 are configured to extend over the shoulders of the wearer to hold the suit in place. Preferably, a bow 62 is secured to the back of the suit as shown. As best seen in FIG. 3B, a belt or sash 63 extends from the knot of the bow in the back of the suit around the front of the suit and returns to the knot of the bow in the back. The appearance is thus one of a ribbon and bow tied around the waist.

As best seen in FIG. 3C, the belt or sash 63 is secured at its top and can be raised from its bottom to reveal a pair of hook receiving eyes 64. Similarly, in the back of the suit, a pair of clasp hooks are located beneath the belt 63 and bow 62 so that they are also hidden. Along the extreme edge of front panel 56 is a pair of hooks 66 that are positioned as illustrated in FIG. 3C to couple with the hook receiving eyes 64 hidden beneath the belt 63. A pair of clasps 67 are provided at the ends of the tabs of the front panel 56 and are adapted to be connected to the clasp hooks beneath the belt and bow in the back of the suit.

It can thus be seen that, with the embodiment of FIGS. 3A through 3C, the suit 51 can be put on in the normal way with the shoulder straps extending over the shoulders. The displaceable section 53 is then swung forward between the legs and up until the front panel 56 covers the tummy. Belt 63 is then lifted up and hooks 56 are engaged with hook receiving eyes 64 to secure the front panel in place. The tabs of the front panel 56 are then extended around to the back of the wearer underneath the belt 63 where the clasps 67 are releasably engaged with the clasp hooks located there. The belt 63 is then lowered so that it covers the top edge of the displaceable portion 53 and also covers the hooks and eyes used for attachment. The result is a suit that exhibits a modern styling design while at the same time has an easily displaceable crotch portion that provides the advantages discussed above relative to the other embodiments.

Finally, FIGS. 4A through 4D illustrate the present invention in a third alternate embodiment. In this embodiment, the swimsuit comprises a separate top portion 71 and bottom portion 72. The top portion 71 is generally tubular in shape and has a pair of shoulder straps 73 and 74. An elastic band 76 extends around the bottom of the top portion 71 and a similar elastic band 77 extends around the top of the bottom portion 72. An auxiliary skirt 78 or sash 79 are provided for covering the elastic bands 76 and 77 when the suit is being worn. The skirt 78 preferably is also provided with an elastic band 81 to hold it in place while the sash 79 is formed of elastic material that tends to hold it tightly around the wearer's torso. Thus, the skirt 81 or the sash 79, when worn, covers the juncture between the bottom portion 72 and top portion 71 and covers their elastic bands so that the suit appears to be a traditional one-piece swimsuit. When a wearer needs to use the restroom, she need only remove the bottom portion 72, thereby avoiding the requirement to remove the entire suit.

Figure 5:
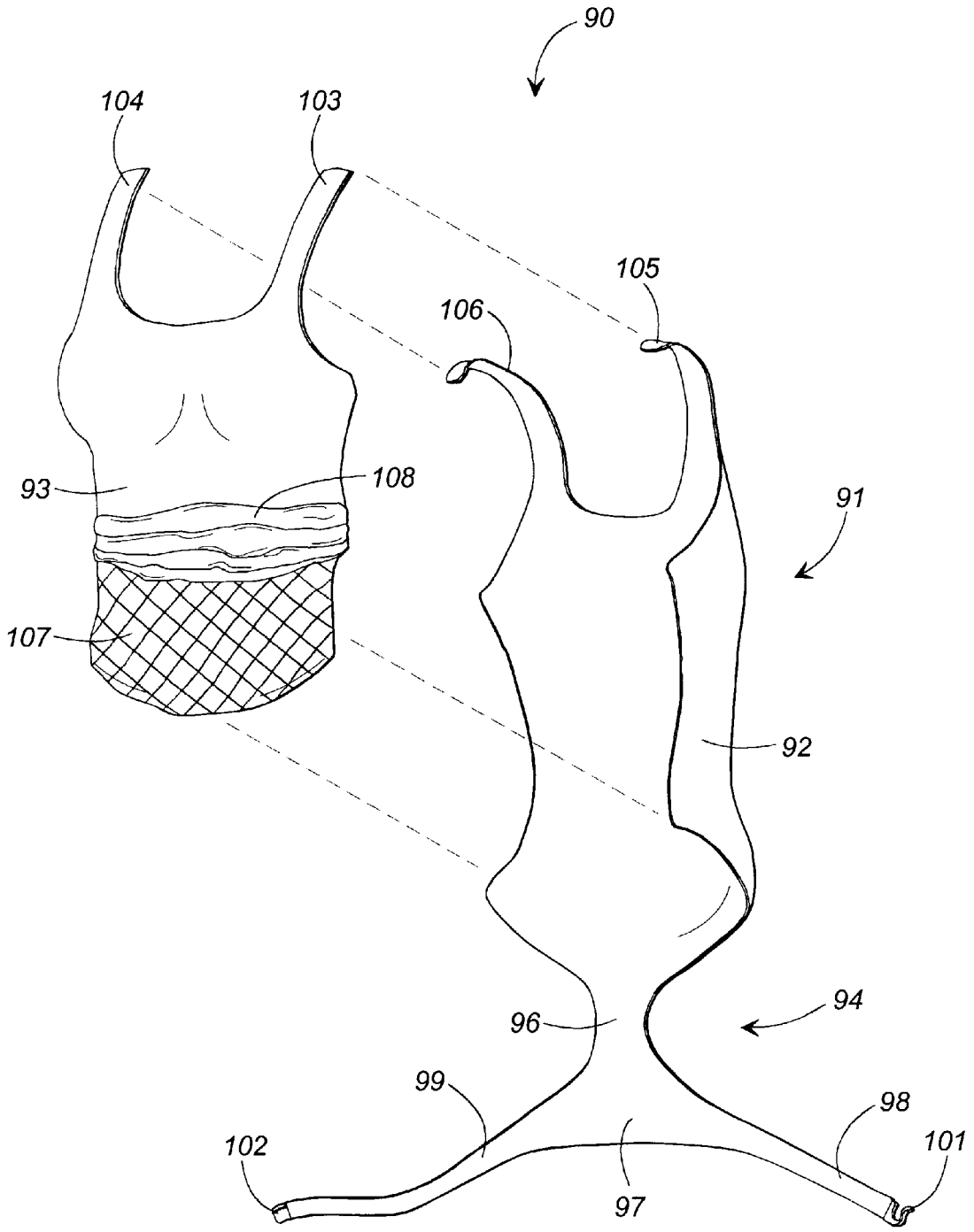
FIG. 5 is a perspective partially exploded view of a swimsuit that embodies principles of the invention in an alternate form.

FIG. 5 illustrates an alternate embodiment of the swimsuit of this invention. The embodiment of FIG. 5 is similar to that of FIG. 1 in that the suit 90 is a one piece swimsuit having an upper portion 91 comprised of a back section 92 and a front section 93. A displaceable portion 94 depends from the back section 92 and includes a narrow crotch section 96 and a wider front panel 97. Belt straps 98 and 99 project outwardly from the front panel 97. Strap 98 terminates at its end in a hook 101 and strap 99 terminates at its end in a corresponding loop 102. Shoulder straps 103/105 and 104/

106 are provided for extending over the shoulders of a wearer to provide a traditional one piece look. Preferably, the front section 93 of the suit 90 has a tummy panel 107 that is made of spandex or other appropriate material to hold the upper portion of the suit in place and to provide tummy control. A belt flap 108 is sewn to the front section 92 of the suit along its top edge. In this way, the belt flap 108 is free along its bottom edge and can be raised and lowered.

In use, the embodiment of FIG. 5 is donned in a manner similar to that of FIG. 1. Specifically, a wearer pulls the suit over her head until the shoulder straps extend appropriately across her shoulders. When this is done, the displaceable portion 94 hangs freely from the back section 92 of the suit. The user then simply swings the displaceable portion 94 forwardly between her legs and pulls the front panel 97 up across her lower torso until it covers the tummy panel 107 and until its upper edge is located beneath and hidden by the belt flap 108. The belt straps 98 and 99 are then wrapped around the wearer's waist, again beneath the belt flap 108, and the hook 101 is inserted into the loop 102 on the back of the swimsuit. The belt flap 108 is then pulled down over the top edge of the front panel 97 and over the portions of the belt straps 98 in the front and on the sides of the suit. In this way, the belt flap 108 covers the top edge of the front panel 97 and a portion of the belt straps 98 and 99 so as to provide a conventional one piece swimsuit look. In practice, the straps 98 and 99 are adjustable so as to provide a tight fit around the wearer's waist to prevent the front panel 97 from sagging downwardly and showing underneath the belt flap 108.

With the suit appropriately applied, the wearer can sunbathe, swim, or engage in any activities for which swimsuits are used. When it is necessary for the wearer to use the restroom, she does not have to take off the entire suit. Instead, she need only disconnect the hook 101 from the loop 102 from the back of the suit, unwrap the belt sections 98 and 99 from around her torso, and swing the displaceable portion 94 down and back between her legs so it is completely out of the way.

Figure 6:
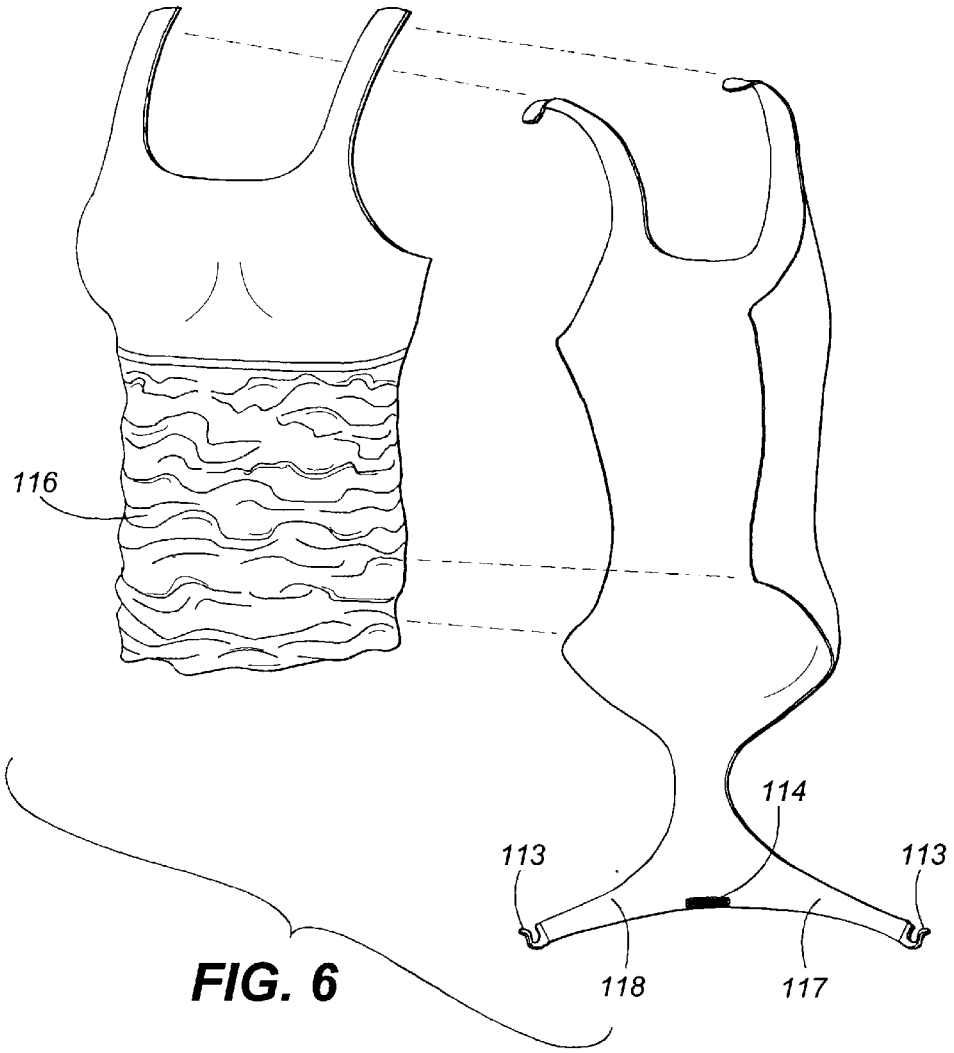
FIGS. 6 and 7 illustrate the present invention in the form of a maternity swimsuit.
Figure 7:
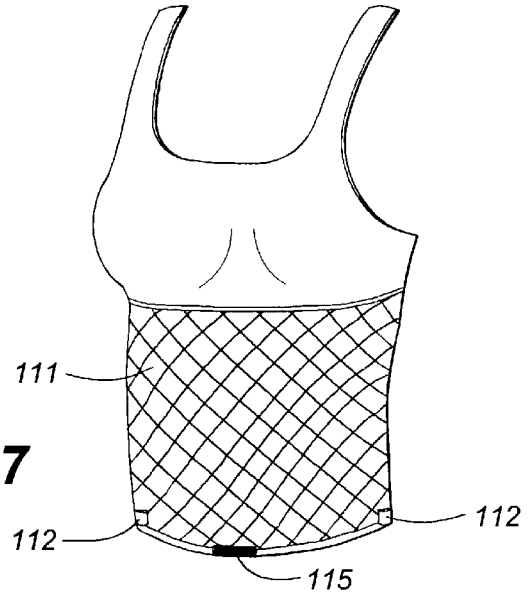

FIGS. 6 and 7 illustrate an embodiment of the present invention designed to be worn by and accommodate the figures of pregnant women. The suit is similar in construction to the suits of FIGS. 1 and 5. However, instead of a spandex tummy panel, this embodiment is provided with a mesh net 111 that extends from the waist upwardly to a position higher than the tummy panel of previous embodiments. The mesh net 111 is made of a stretchable expandable material so as to accommodate the protruding tummy of a pregnant wearer. As illustrated in FIG. 6, a loosely gathered cover panel 116 is sewn to the front section of the suit and covers the mesh net 111. The gathered cover panel 116, because of its gathered nature, is also able to expand greatly to accommodate the tummy of a pregnant wearer while at the same time covering the mesh net and the wearer's tummy. In order to prevent a pregnant wear from having to reach around her back to disconnect the hook and loop of the embodiment of FIG. 5, the belt straps 117 and 118 in this embodiment are much shorter and each terminates in hook 113. The hooks 113 are designed to be attached to corresponding loops 112 (FIG. 7) on the front section and located at the sides of the wearer's waist. Hook and loop fasteners, such as Velcro patches 114 and 115 are provided along the top of the front panel and the bottom of the mesh net respectively to hold the front panel of the suit securely in place. As with previous embodiments, the gathered cover panel 116 covers and hides the top edge of the front panel of the suit so as to provide a normal one piece bathing suit appearance.

The invention has been described herein in terms of preferred embodiments. Obviously, advantageous additions, deletions, and modifications might well be made to the illustrated embodiments by persons of ordinary skill in this art. For example, while the suits have been illustrated generally for use by slender women, they have been found to be particularly suited for use by pregnant women as well and larger women. For these latter two groups, putting on and taking off a wet bathing suit can be particularly difficult and especially embarrassing in public restrooms. Further, while belts, sashes, and skirts have been shown extending around the waist of the wearer to hold up the displaceable portion when the suit is in use, it is well within the scope of the invention that other means for attaching or holding up the displaceable portion in normal use be provided. Finally, the styles shown and illustrated for the preferred embodiments are generally simple one-piece swimsuit styles. Obviously, a wide variety of styles could be developed employing the principles of the present invention and any such style is contemplated to be within the scope of the invention. These and other modifications and improvements might well be made to the illustrated embodiments by persons of skill in the art without departing from the spirit and scope of the invention as set forth in the claims.

I claim:

1. A swimsuit for a pregnant wearer, said swimsuit comprising an upper portion for covering the upper body of the wearer, said upper portion having a front section for covering the front of the wearer and a back section for covering the back of the wearer, said front section being provided with a mesh net panel in the region of the wearer's tummy for expanding to accommodate the tummy during pregnancy and an expandable decorative cover panel covering the mesh net and hiding the wearer's tummy.

2. A swimsuit as claimed in claim 1 and further comprising a displaceable portion contiguous with and depending from said back section of said upper portion, said displaceable portion comprising a relatively narrow crotch section extending from said back section and a relatively wider front panel having an edge and opposed ends extending from said crotch section, a first fastener at one end of said front panel, a second fastener at the opposed end of said front panel, and means on said swimsuit at the wearer's waist for receiving and releasably fastening to said first and second fasteners to hold said displaceable portion in place with its crotch section covering the wearer's crotch.

3. A swimsuit as claimed in claim 2 and further comprising a first hook and loop fastener strip along said top edge of said front panel and a second hook and loop fastener strip on said front section for receiving and releasably fastening to said first hook and loop fastener strip to hold said front panel in place at the front of said swimsuit.

* * * * *